US005661550A

United States Patent [19]

Ko

[11] Patent Number: 5,661,550

[45] Date of Patent: Aug. 26, 1997

[54] METHOD AND APPARATUS FOR DETECTING A WIDTH OF A PRINTING MEDIUM MANUALLY FED TO AN IMAGE FORMING APPARATUS

[75] Inventor: Chang-Kyung Ko, Suwon, Rep. of Korea

[73] Assignee: SamSung Electronics Co., Ltd., Suwon, Rep. of Korea

[21] Appl. No.: 573,776

[22] Filed: Dec. 18, 1995

[30] Foreign Application Priority Data

Dec. 16, 1994 [KR] Rep. of Korea ..... 34657/1994

[51] Int. Cl.[6] ..... G03G 15/00

[52] U.S. Cl. ..... 399/45; 250/559.24

[58] Field of Search ..... 355/311, 313, 355/309; 250/559.24, 559.19

[56] References Cited

U.S. PATENT DOCUMENTS

| | | | |
|---|---|---|---|
| 3,597,075 | 8/1971 | Kobayashi . | |
| 3,751,155 | 8/1973 | Liechty . | |
| 4,649,403 | 3/1987 | Miura . | |
| 4,672,465 | 6/1987 | Ono . | |
| 4,839,695 | 6/1989 | Yamamoto et al. . | |
| 4,890,125 | 12/1989 | Egawa et al. . | |
| 5,032,876 | 7/1991 | Murakami | 355/311 X |
| 5,117,258 | 5/1992 | Iwata | 355/311 X |
| 5,121,169 | 6/1992 | Kawabata . | |
| 5,126,580 | 6/1992 | Hiraoka et al. . | |
| 5,216,256 | 6/1993 | Kusumoto et al. | 250/548 |
| 5,222,722 | 6/1993 | Kamano . | |
| 5,252,991 | 10/1993 | Storlie et al. . | |
| 5,291,225 | 3/1994 | Saito . | |
| 5,321,486 | 6/1994 | Nanbu et al. . | |
| 5,328,166 | 7/1994 | Hokamura . | |
| 5,424,821 | 6/1995 | Sampath . | |
| 5,438,345 | 8/1995 | Hisaaki | 347/218 |

*Primary Examiner*—R. L. Moses
*Attorney, Agent, or Firm*—Robert E. Bushnell, Esq.

[57] ABSTRACT

A printing medium width detecting device an image forming apparatus, which has a plurality of sensors for detecting the width of the printing medium at a manual printing medium feeding unit. Unnecessary exposure, developing and transfer can be avoided outside a region where the printing is required by controlling exposure in accordance with the sensed width, thereby reducing toner consumption. The printing medium width detecting device utilizes a plurality of sensors disposed perpendicular to a printing medium feeding direction in the path of manually fed printing medium of an image forming apparatus, for generating a sensing signal recognized by a control unit as the width of the printing medium to control the exposure of a photosensitive drum.

13 Claims, 5 Drawing Sheets

METHOD AND APPARATUS FOR DETECTING A WIDTH OF A PRINTING MEDIUM MANUALLY FED TO AN IMAGE FORMING APPARATUS

CROSS REFERENCE TO RELATED APPLICATION

This application refers to, incorporates herein and claims all benefits accruing under 35 U.S.C. §119 from an application entitled Printing Medium Width Detecting Device Upon Manually Feeding Printing Medium in an Image Forming Apparatus, that was earlier filed in the Korean Industrial Property Office on Dec. 16, 1994 and there assigned Ser. No 34657/1994.

BACKGROUND OF THE INVENTION

1. Field of the Invention

The present invention relates to improvements in devices and methods for detecting the width of a printing medium in an image forming apparatus, and more particularly, to a printing medium width detecting device for a manual feeding unit, which has a plurality of sensors for automatically detecting the real width of the printing medium and avoiding unnecessary exposure, developing and transfer outside a region where printing is required, thereby reducing toner consumption and contamination of an image transfer unit.

2. Description of the Background Art

After a conventional image forming apparatus is switched on, a controller managing overall operation stores preset basic values regarding a size of a printing medium to be printed and conditions for the developing processing units prior to entering a ready state awaiting a print command. Typically, a standard size printing medium (e.g. paper) such as A4, Legal, or Letter selected by a user may be supplied to the image forming apparatus by an automatic printing medium feeding cassette. When a print command is generated, the controller receives information regarding the size of the printing medium in accordance with size detection switches provided on the side of the cassette mounting portion. The controller compares the received information with the preset basic values, and may store new values corresponding to the assumed size of the printing medium held by the inserted cassette in place of the preset basic values. Image data for one page is then generated by the controller in accordance with the recognized size of the selected printing medium, to produce an electrostatic latent image and transfer developing material onto the surface of a photosensitive dram in a region contacted by the printing medium.

A manual feeding unit is commonly employed when a user selects a non-standard size printing medium or frequently changes the size of the printing medium selected, such as that disclosed in U.S. Pat. No. 5,222,722 issued to Kamano on Jun. 29, 1993 and incorporated herein by reference. The controller for the imaging apparatus is generally unable to determine the width of a printing medium supplied by a manual feeding unit however, and image forming operations are performed based on preset basic or input values without regard to the actual width of the printing medium. No problems occur when the preset basic or input value is narrower than the actual width of the printing medium fed through the manual feeding unit. On the other hand, if the actual width of the printing medium is narrower than a width of image data exposed onto the photosensitive dram, developing material adheres to a region of the dram not contacted by the printing medium and is instead transferred to the surface of the transfer unit. This results in unnecessary toner consumption and contamination of the transfer unit, causing progressively deteriorating print quality.

A Method and Device for Saving Toner and Preventing Contamination in an Image Forming Apparatus is disclosed in U.S. patent application Ser. No. 08/535,874, claiming priority under 35 U.S.C. §119 on Korean Patent Application No. 25701/1994 and assigned to the assignee of the present invention, Samsung Electronics Co., Ltd. A controller for an image forming apparatus utilizes a sensed width of a manually fed printing medium to generate a latent image only in a reduced printing area. A slide bar attached to a variable resistor must be physically moved by a user to coincide with the edge of a manually fed printing medium to detect the width however, requiring extra effort by the user and potential mistaken adjustments.

U.S. Pat. No. 4,672,465 discloses an Image Forming Apparatus for detecting the shape of a paper sheet supplied to a manual feeding path of a thermal printer. A shape detecting apparatus is provided, having an array of light detecting elements and light emitting elements disposed respectively above and below a manual feeding path in a line parallel to the widthwise direction, so that the light transmission path for each emitter/detector pair is selectively blocked according to the width of the paper. A transparent printing medium such as MYLAR however, can not be detected by the disclosed light emitting elements. A mechanical alternative using an array of rotatable lever elements to actuate a lead switch is only briefly mentioned and would appear to be unreliable.

SUMMARY OF THE INVENTION

It is therefore an object of the present invention to prevent unnecessary toner consumption and maintain efficient operation of an image forming apparatus, by controlling exposure in accordance with a sensed width of a printing medium.

It is a further object to provide a printing medium width detecting device which automatically senses a width of a manually fed printing medium without user intervention.

Still another object is to provide a printing medium width detecting device mounting a plurality of rotatable sensors arrayed at an angle to the feeding direction, for automatically detecting the width of a printing medium as it is conveyed by a manual feeding unit.

Yet another object is to provide a printing medium width detecting device mounting a plurality of sensors spaced within a relatively narrow interval and contacting a printing medium, in order to accurately sense the width of the printing medium.

These and other objects may be achieved with a printing medium width detecting device for a printing medium manual feeding unit in an image forming apparatus constructed according to the principles of the present invention, having a plurality of sensors disposed in the path of a manually fed printing medium at an angle to the feeding direction for generating a sensing signal, and a control unit for recognizing the actual width of the printing medium in accordance with the sensing signal and forming an image only within a region corresponding to the sensed width of the printing medium. A method according to the principles of the present invention includes the steps of automatically sensing a width of a printing medium manually fed to an image forming apparatus, determining a recognized width of the manually fed printing medium, and forming an image only within a region corresponding to the recognized width of the printing medium.

BRIEF DESCRIPTION OF THE DRAWINGS

A more complete appreciation of the invention, and many of the attendant advantages thereof, will be readily apparent as the same becomes better understood by reference to the following detail description when considered in conjunction with the accompanying drawings in which like reference symbols indicate the same or similar components, wherein.

DETAILED DESCRIPTION OF THE PREFERRED EMBODIMENT

Figure 1:
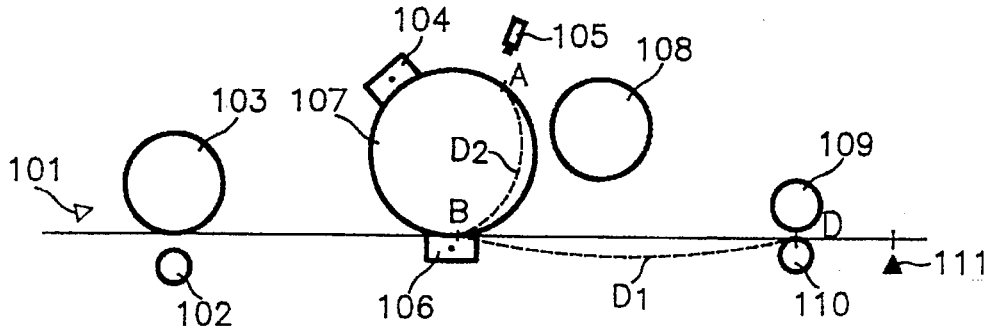
FIG. 1 is a schematic diagram illustrating a conventional image forming apparatus.

Turning to the drawings and referring first to FIG. 1, the construction of a conventional image forming apparatus is schematically illustrated. A charging unit 104 provides a uniform negative charge onto the surface a photosensitive drum 107, then an exposing unit 105, for example a laser, scans an electrostatic latent image onto the charged surface by selectively discharging the uniform charge. A developing material (e.g.. toner) is negatively charged by a developing unit 108 and is therefore attracted only to the electrostatic latent image, and then the developing material is transferred to the printing medium by a transfer unit 106. A fixing unit 103 driven against an idle roller 102 fixes the transferred developing material onto the printing medium.

When a print command is received, a printing medium is conveyed a distance (D1–D2) by a register roller 109 driven against an idle roller 110, to align the top margin of the printing medium in an initial position. The initial position is calculated by subtracting a circumferential distance D2, measured between a point A on the photosensitive drum 107 adjacent the exposure unit 105 and a point B adjacent the transfer unit 106, from a distance D1, measured between the same point B and a point D adjacent the register roller 109. Thereafter, a first horizontal latent image line generated by the exposing unit 105 at the point A, will arrive at the point B simultaneously with the top of the printing medium, as the photosensitive dram 107 and register roller 109 are rotated in tandem. If problems occur during conveyance of the printing medium, jam sensors 101 and 111 generate a signal indicating an abnormal status.

Figure 2:
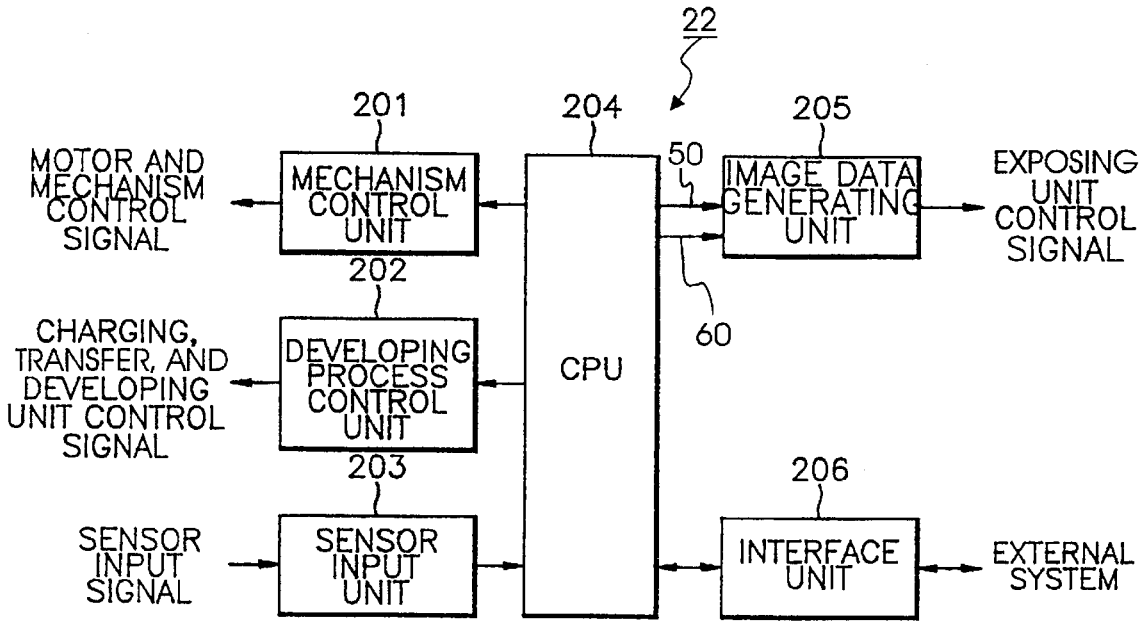
FIG. 2 is a circuit diagram illustrating an internal controller of an image forming apparatus.

FIG. 2 illustrates the construction of an internal controller 22 for controlling the image forming apparatus, in which a central processing unit (CPU) 204, provided with read/write memory, coordinates overall system operation through a plurality of input/output data and control units. A mechanism control unit 201 generates mechanism and motor control signals for controlling the movement of various imaging apparatus components, and a developing process control unit 202 generates power voltage supply and control signals for the charging unit 104, developing unit 108 and transfer unit 106 illustrated in FIG. 1. A sensor input unit 203 receives sensed values from various kinds of sensors, including the aforementioned jam sensors 101 and 111.

Figure 4:
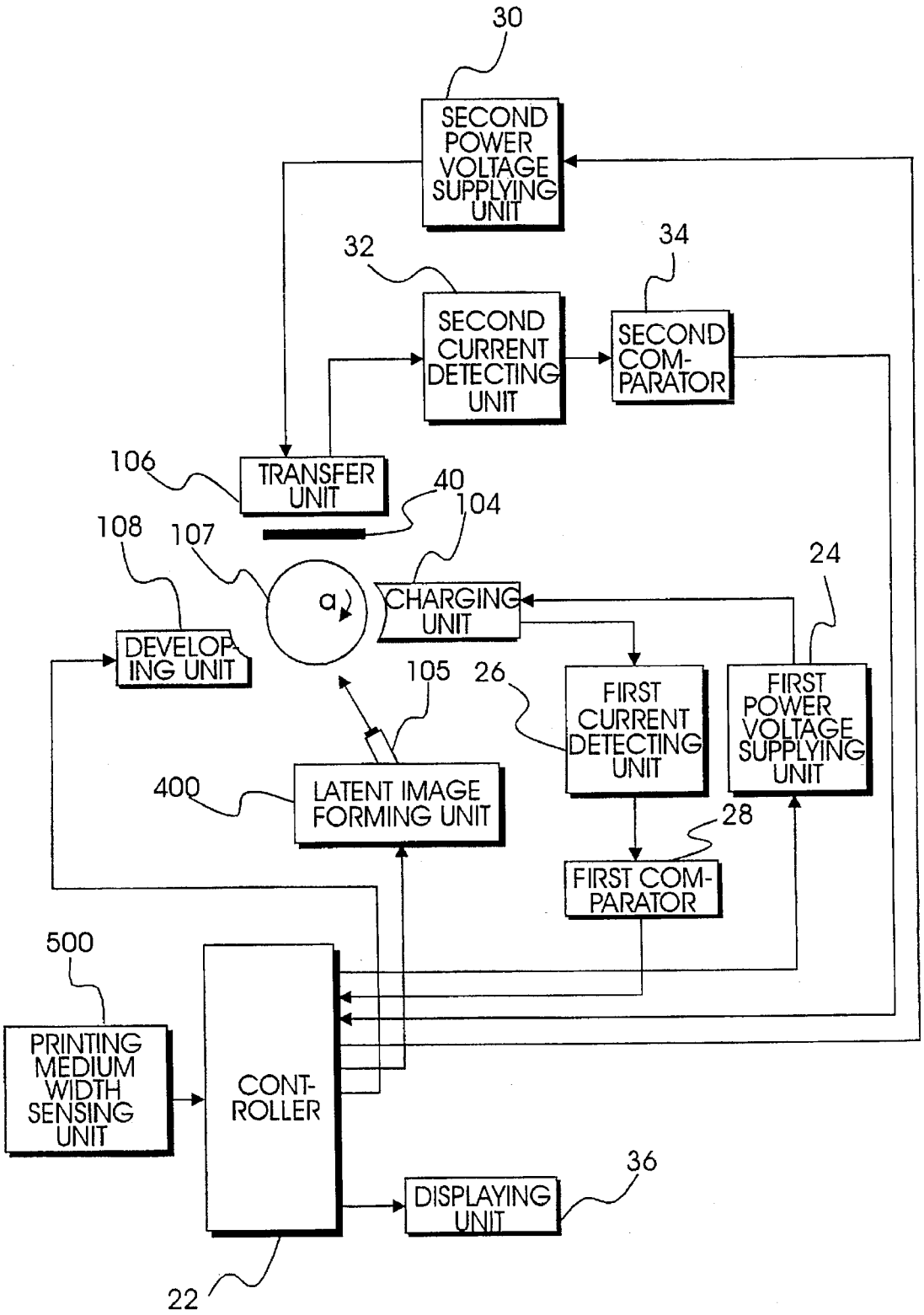
FIG. 4 is a schematic illustration of an image forming apparatus constructed according to the principles of the present invention.

Data to be printed on a printing medium is received by the CPU 204 through an interface unit 206 connecting the image forming apparatus to an external system, such as a personal computer. CPU 204 in turn provides to an image data generating unit 205, both a video data signal 60 corresponding to each horizontal line forming one entire page of an image, and a video action control signal 50. Image data generating unit 205 includes an AND gate for logically combining the two signals as described hereinafter with respect to FIGS. 7A and 7B. The logical combination forms an exposing unit control signal which is supplied to exposing unit 105 via a latent image forming unit 400 (FIG. 4). Alternatevely, the two signals 50 and 60 may be provided via seperate signal lines to the latent image forming unit 400 and logically combined therein.

Figure 3:
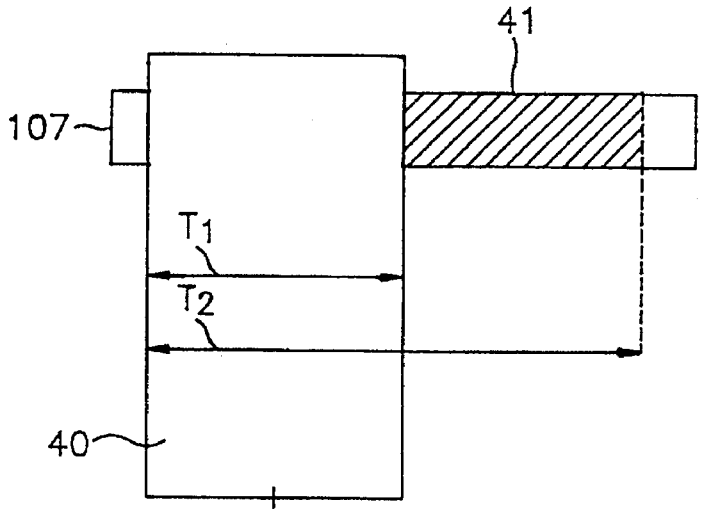
FIG. 3 is a diagram illustrating a conventional manual feeding unit imaging process.

As illustrated in FIG. 3, if the width T1 of a printing medium 40 is narrower than the preset or input width T2 of an electrostatic latent image exposed onto the photosensitive drum 107, excess toner will be attracted to the hatched portion 41 of the drum 107. The excess toner then contaminates the transfer unit 106, resulting in progressively deteriorating printing performance, and the amount of toner consumed and waste toner generated correspondingly increase.

FIG. 4 is a schematic illustration of an image forming apparatus constructed according to the present invention, which includes a printing medium width sensing unit 500 for sensing the width of printing medium supplied through a manual feeding unit. A similar image forming apparatus without the printing medium width sensing unit 500 is disclosed in the U.S. Pat. No. 4,890,125 issued to Egawa on Dec. 26, 1989, incorporated herein by reference, and will be more completely understood by reference to the patent. Controller 22 receives the output from the printing medium width sensing unit 500, and performs an image forming operation by controlling a latent image forming unit 400 and transfer unit 106, in a manner similar to that disclosed in the Egawa '125 patent.

Figure 5A:
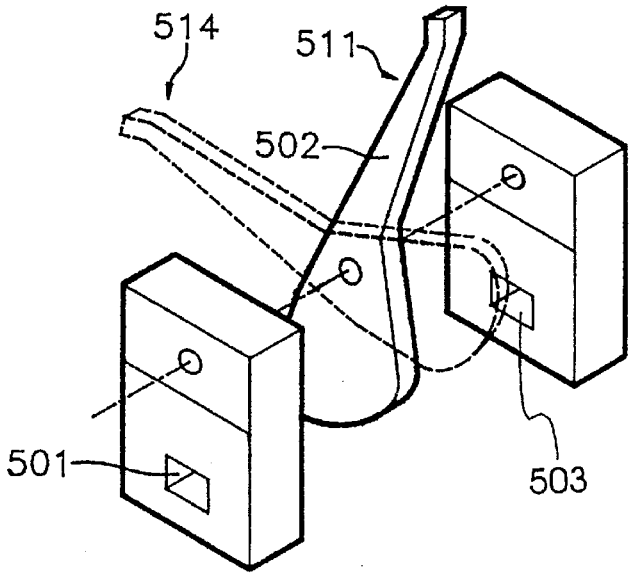
FIG. 5A is a perspective view illustrating the construction of a detector for sensing the width of printing medium according to a preferred embodiment of the present invention.
Figure 5B:
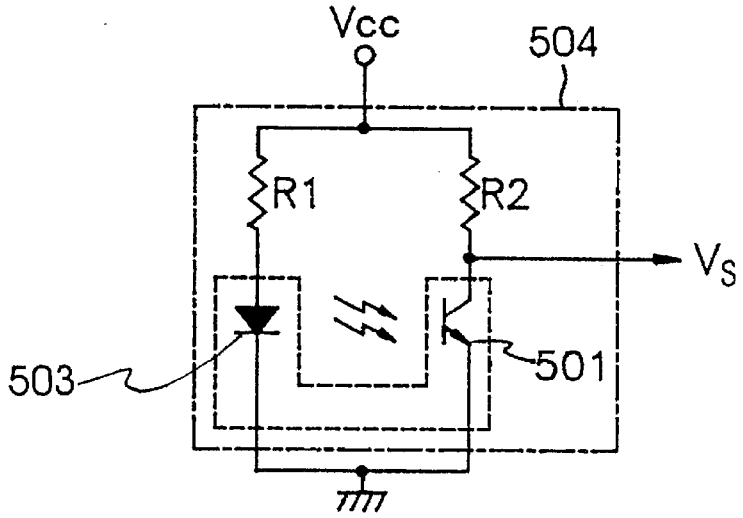
FIG. 5B is a schematic diagram of a circuit for generating a detecting signal corresponding to the width of the printing medium according to a preferred embodiment of the present invention.

FIGS. 5A and 5B illustrate an individual sensor from an array of sensors $S_n$ installed in a printing medium width detecting unit, preferably located in the lower portion of a manual feeding unit according to the present invention. Each sensor is formed by an actuator 502 rotationally biased by gravity or a spring in a first position 511 interposed between a light emitting diode 503 and a phototransistor 501. When a printing medium is fed into a manual feeding unit, the printing medium may contact actuator 502 depending upon the width of the printing medium, rotating the actuator 502 in a printing medium feeding direction to a second position 514 permitting light emitting diode 503 to illuminate phototransistor 501.

FIG. 5B is a schematic diagram of a sensor circuit 504 of each sensor illustrated in FIG. 5A, for generating a signal according to the position of the actuator. A supply voltage $V_{CC}$ is applied through a resistor R2 to the collector of phototransistor 501, and through a resistor R1 to continuously drive light emitting diode 503. A sensed voltage $V_S$ at the collector is dependent upon the position of the actuator 502. When a printing medium is not present or is not wide enough to contact a particular actuator 502, a corresponding phototransistor 501 is turned off and the sensed voltage $V_S$ is substantially equal to the supply voltage $V_{CC}$. On the other hand, when the actuator 502 is rotated by the printing medium to a position where the light emitting diode 503 illuminates the base and turns on phototransistor 501, the sensed voltage $V_S$ at the collector is substantially reduced by current flowing through the emitter to ground. Accordingly, sensed voltages $V_S$ generated by each of a plurality of sensor circuits 504 in combination provide a width detecting signal indicative of the actual width of a manually fed printing medium. In an alternative embodiment, actuator 502 and sensor circuit 504 may be replaced by an array of very sensitive micro switches activated directly by the printing medium passing over the contact surface.

Figure 6:
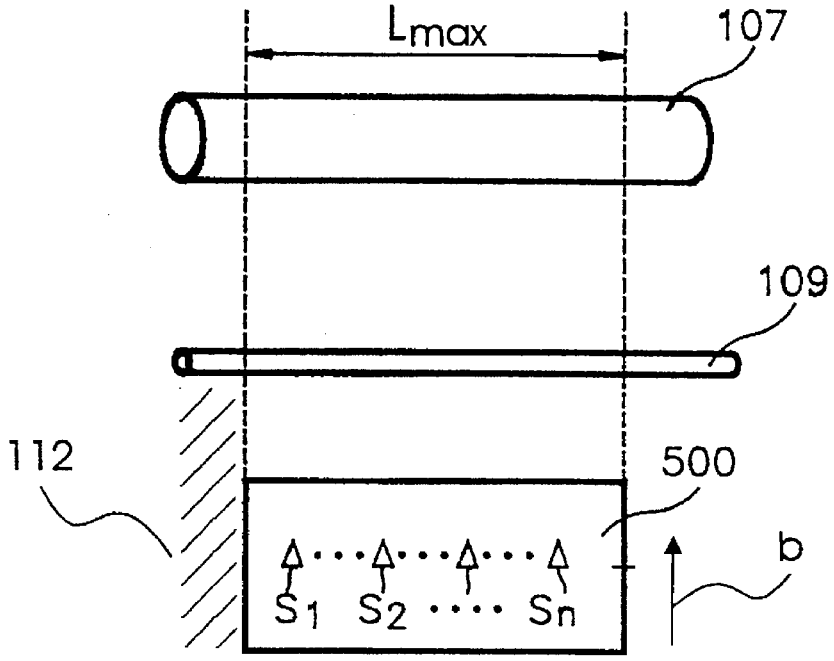
FIG. 6 is a diagram illustrating a preferred arrangement of the printing medium width sensing unit relative to portions of the image forming apparatus.

FIG. 6 illustrates a construction of the printing medium width sensing unit 500, in which a plurality of sensors S1 to Sn, as illustrated in FIGS. 5A and 5B, are installed within the maximum printing width $L_{max}$ along a line perpendicular to the printing medium feeding direction b. The sensors of the width sensing unit 500 preferably located at predetermined distances adjacent a guide edge 112 of the manual feeding unit, but may alternatively be located within the aforementioned distance (D2-D1) in the feed path between the register roller 109 and photosensitive drum 107. The sensors may alternatively be installed along a slanted line relative to the feeding direction b or in a zig-zag pattern.

FIGS. 7A(*a*) to 7A(*d*) illustrate a general example of an exposure control process in which the width of the electrostatic latent image is formed without regard to a sensed width of a manually fed printing medium. A horizontal synchronization signal (a), hereinafter H_Sync, is generated to indicate the beginning of each new electrostatic latent image scanning line. A specified time thereafter, video action signal (b), hereinafter VD-ACT, is generated corresponding to a standard width X derived from a preset basic or input value for the printing medium. VD-ACT is logically ANDed with each line of image data, i.e. video data waveform (c), to generate a resultant logical combination signal for controlling the latent image forming unit to generate each line of the electrostatic latent image (d) having a standard width X. The signal VD-ACT is conventionally maintained at a logical high value throughout an image area of standard width X, and thus all of the video data generated is represented in the electrostatic latent image.

FIGS. 7B(*a*) to 7B(*d*) illustrate a transfer control process according to the present invention, in which the VD-ACT signal (b) is generated corresponding to a width L recognized by the controller 22 as the actual width of a manually fed printing medium. When VD-ACT is logically ANDed with the video data waveform (c), a truncated electrostatic latent image line (d) will be generated to avoid unnecessary toner consumption and contamination. That is, some of the generated video data will be ignored while VD-ACT has a logic low value, and no electrostatic latent image will be formed in a region Y external to the width L of the printing medium.

Typically, there are two methods for manually feeding a printing medium to an image forming apparatus; a center loading method and a side loading method. In a side loading method, the printing medium is always inserted with one side adjacent a particular guide edge (e.g. left) of the manual feeding unit. In a center loading method, the printing medium should be centered between opposites edges of the manual feeding unit.

Figure 7C:
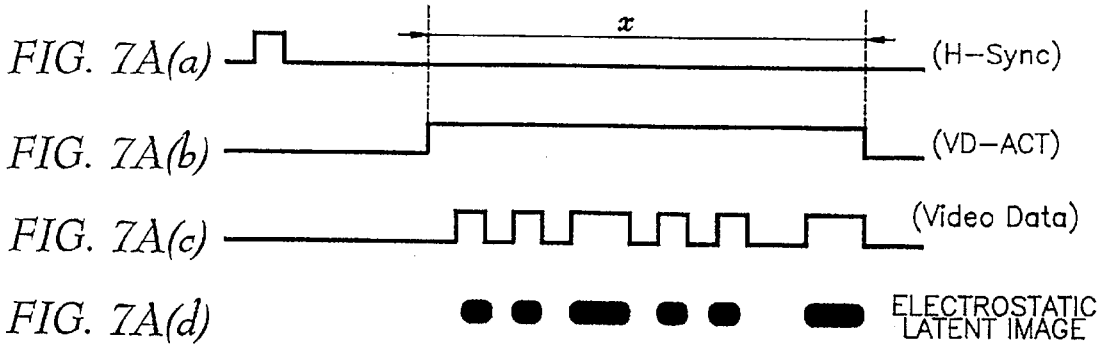
FIGS. 7A(*a*) to 7D are views illustrating the latent image forming control process of an image forming apparatus according to the present invention.
Figure 7C:
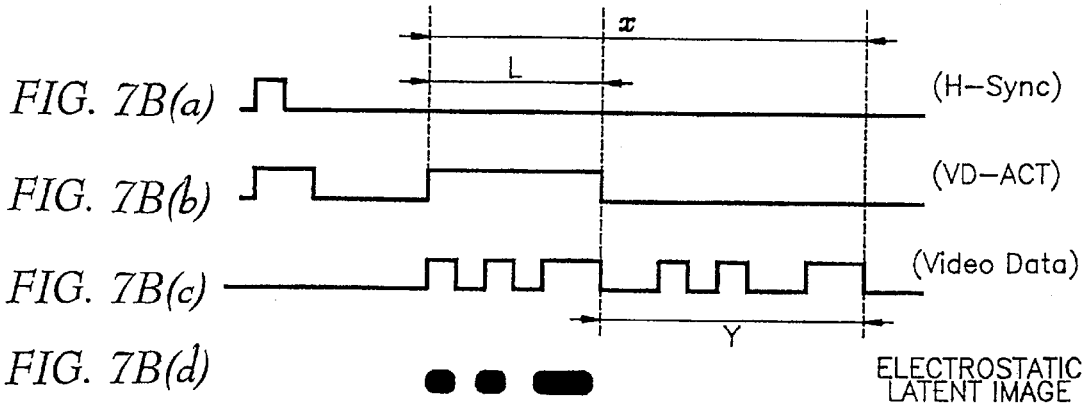
Figure 7C:
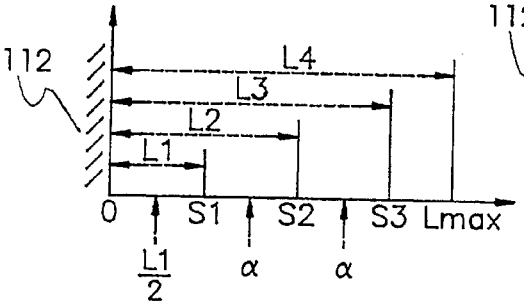

FIG. 7C shows a side loading embodiment of the present invention, in which three sensors, S1 to S3, are installed at known distances, L1 to L3, from the guide edge 112 in order to sense the width of a manually fed printing medium. Each sensor is "activated" when the Voltage $V_S$ of the sensor circuit, applied to the controller 22, changes in response to rotation of the corresponding actuator by contact with the printing medium. In accordance with the sensed width of the printing medium, the controller 22 controls the latent image forming unit 400 and the transfer unit 20, thereby forming the image.

When only a first sensor S1 is activated, the controller 22 recognizes that the actual width of the printing medium is between known widths L1 and L2, and the VD-ACT signal used in the image forming process is generated corresponding to a predetermined value between the widths L1 and L2, or alternatively to an arbitrary lesser value (e.g. L½). In the same manner, when both a first sensor S1 and second sensor S2 are activated, the VD-ACT signal is generated corresponding to an arbitrary recognized width between L2 and L3. When all three sensors S1 to S3 are activated, the VD-ACT signal may be generated corresponding to the maximum width $L_{max}$. The actual width of the printing medium can be recognized more exactly as the number of sensors is increased and the interval between the sensors is diminished.

Figure 7D:
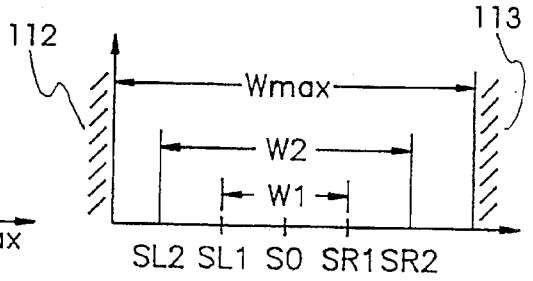

FIG. 7D shows another embodiment where seven sensors are installed to sense the width of a printing medium manually fed using a center loading method. The sensors are installed symmetrically to the left and right sides of a center sensor SO. In the center loading method, since the printing medium is fed centered between the edges 112 and 113 of the manual printing medium feeding unit, the center sensor SO is always driven when a printing medium is present, and the recognized width the printing medium is set between 0 and W1. Similar to the above description of the side loading method, when sensors SL1 and SR1 are activated, a predetermined value between W1 and W2

Generally, the controller 22 recognizes that the width of the printing medium is between a sensor generating a sensing signal and an adjacent sensor generating no sensing signal. If the sensors (SL1 and SR1) and SO are recognized, the controller 22 recognizes the width of the printing medium as a value between W1 and W2, enabling the latent image to be formed only in a portion therebetween. If all of the sensors are recognized, the controller 22 recognizes the width of the printing medium as a constant value between Wmax and W2. Since the printing medium is symmetrically fed in the center loading method, even if one of a pair of sensors (SL2 and SL1) or (SR2 and SR1) is omitted or fails to operate, the controller 22 controls the width of the printing medium in the same manner as described above.

Regardless of whether the side loading method or the center loading method is used, the controller 22 controls the latent image forming unit 400 to form the latent image in accordance with the printing medium width sensing value. Thus, the controller 22 forms the electrostatic latent image to be printed only in a portion corresponding to the recognized width of the printing medium, in the effective printing area L, in the manner shown in FIGS. 7B(*a*) to 7B(*d*);

As apparent from the foregoing, the width of a manually fed printing medium can be automatically detected according to the present invention, and unnecessary exposure, developing and transfer eliminated outside a region where the printing is required through control of the exposure signal, consequently reducing toner consumption. Moreover, generation of waste toner is advantageously reduced, and excessive contamination and consequent deterioration of the transfer unit can be prevented.

While I have shown and described certain present preferred embodiments of the invention and have illustrated certain present preferred methods of practicing the same it is to be distinctly understood that the invention is not limited thereto but may be otherwise variously embodied and practiced within the scope of the following claims.

What is claimed is:

1. A printing medium width detecting device for an image forming apparatus, comprising:

a plurality of sensors disposed perpendicular to a printing medium feeding direction in a path of a printing medium manually fed through an image forming apparatus, for generating a sensing signal in correspondence with the width of the printing medium; and control means for determining a recognized width of the printing medium in accordance with said sensing signal, for generating a control signal having a first voltage level for a duration corresponding only to said recognized width, and for receiving image data from an external source and transferring said received image data to the image forming apparatus only during a time when said control signal maintains said first voltage.

2. The device as recited in claim 1, wherein each of said plurality of sensors comprises an actuator and a sensor circuit comprising a light emitting diode and phototransistor, and said sensing signal is a combination of voltage values produced by each said sensor circuit.

3. The device as recited in claim 1, wherein each of said plurality of sensors comprises micro switch.

4. The device as recited in claim 1, wherein said control means determines said recognized width of the printing medium on the basis of a sensor generating a voltage signal and an adjacent sensor generating no voltage signal.

5. An image forming apparatus including a manual printing medium feeding device, comprising:

a plurality of sensors disposed at an angle to a printing medium feeding direction, for generating a sensing signal in correspondence with the width of the printing medium fed to the manual printing medium feeding device;

a photosensitive surface for receiving an electrostatic latent image, receiving toner in a pattern corresponding to said electrostatic latent image, and transferring the toner to the printing medium; and control means for recognizing the width of the printing medium in accordance with said sensing signal generated from said plurality of sensors and controlling an exposure signal so as to form said electrostatic latent image only within a region of said photosensitive surface corresponding the recognized width of the printing medium.

6. The device as recited in claim 5, wherein each of said plurality of sensors comprises an actuator and a sensing circuit for generating a voltage forming said sensing signal, each said sensing circuit comprising a light emitting diode and phototransistor, wherein said actuator is rotated by the printing medium between a first position blocking reception by said phototransistor of light emitted by said light emitting diode, and a second position enabling reception by said phototransistor of light emitted by said light emitting diode.

7. The device as recited in claim 5, wherein each of said plurality of sensors comprises a micro switch.

8. The device as recited in claim 5, further comprising said control means generating a control signal in accordance with said recognized width, wherein the width of the printing medium recognized by said control means is a predetermined value in a range corresponding to a distance between a guide edge of the manual printing medium feeding device and a sensor generating a sensing signal, and the guide edge and an adjacent sensor generating no sensing signal.

9. A control device for an image forming apparatus, the control device comprising:

a plurality of rotatable actuators disposed at intervals in a direction transverse to a printing medium feeding direction in the path of a printing medium fed through the image forming apparatus;

a plurality of sensor circuits corresponding in number to said plurality of actuators, each said sensor circuit comprised of a phototransistor and light emitting diode disposed on opposite sides of each said actuator, each sensor circuit generating a sensing voltage signal in accordance with the position of a said actuator, a combination of said sensing voltage signals indicating a width of the printing medium; and control means for determining a recognized width of the printing medium in accordance with said combination of said sensing voltage signals, and for generating an image control signal having a duration corresponding to said recognized width of the printing medium;

latent image forming means for generating an electrostatic latent image exposure signal in accordance with a logical combination of said control signal and received image data.

10. The control device as recited in claim 9, wherein said control means begins generating said image control signal a specified time period after generating a horizontal synchronization signal.

11. The control device as recited in claim 9, further comprising said control means generating a control signal in accordance with said recognized width, wherein the width of the printing medium recognized by said control means is a predetermined value in a range corresponding to a distance between a guide edge of the manual printing medium feeding device and a sensor generating a sensing signal, and the guide edge and an adjacent sensor generating no sensing signal.

12. The control device as recited in claim 9, wherein said plurality of rotatable actuators are disposed at predetermined equally spaced intervals from a printing medium guide edge of the image forming apparatus along a straight line perpendicular to the printing medium feeding direction in the path of a printing medium fed through the image forming apparatus.

13. The control device as recited in claim 9, wherein a first one of said plurality of rotatable actuators is disposed centered between opposite printing medium guide edges of the image forming apparatus, and the remaining said plurality of rotatable actuators are symmetrically disposed at predetermined equally spaced intervals on either side of said first one of said plurality of rotatable actuators.

* * * * *